US005863044A

United States Patent [19]

Ince

[11] Patent Number: 5,863,044

[45] Date of Patent: Jan. 26, 1999

[54] GAME AND ASSOCIATED APPARATUS

[76] Inventor: Nicholas Edward Ince, 23 New Kings Road, Fulham, London SW6 4SB, Great Britain

[21] Appl. No.: 566,914

[22] Filed: Dec. 4, 1995

[30] Foreign Application Priority Data

Dec. 5, 1994 [GB] United Kingdom ..... 9424499

[51] Int. Cl.[6] ..... A63F 1/00

[52] U.S. Cl. ..... 273/430; 463/27

[58] Field of Search ..... 273/292, 297, 273/148 R, 148 A, 430, 431, 432; 434/209, 192, 348, 405, 427, 322; 463/26, 27, 25, 28

[56] References Cited

U.S. PATENT DOCUMENTS

| | | | |
|---|---|---|---|
| 4,731,027 | 3/1988 | Phinney | 434/348 |
| 5,042,818 | 8/1991 | Weingardt | 463/27 |
| 5,275,400 | 1/1994 | Weingardt et al. | 463/27 |
| 5,286,023 | 2/1994 | Wood | 463/27 |
| 5,603,502 | 2/1997 | Nakagawa | 273/292 |

OTHER PUBLICATIONS

John Scarne, Scarne's Encyclopedia of Games, p. 569, 1973.

Rolling Good Times On Line, "Team Play at Blackjack", pp. 2–5, Oct. 1996.

*Primary Examiner*—Steven Wong

*Attorney, Agent, or Firm*—Lahive & Cockfield, LLP

[57] ABSTRACT

The specification describes a game comprising a novel method of apportioning an initial stake, wherein a greater proportion of the stake is allocated to a player with the lowest score. It is primarily intended for allocating a donation to charity by playing a game and using the score to determine the individual contributions to the donation. Other donations, collective payments, and the like are also included. Where the "score" is, in fact, a ranking, the method of the invention gives a proportion to be paid back.

1 Claim, 4 Drawing Sheets

| SCORES | 0 | 1 | 2 | 3 |
|---|---|---|---|---|
| 000 | 0·333 | — | — | — |
| 001 | 0·400 | 0·200 | — | — |
| 002 | 0·429 | — | 0·142 | — |
| 003 | 0·444 | — | — | 0·111 |
| 011 | 0·500 | 0·250 | — | — |
| 012 | 0·545 | 0·272 | 0·182 | — |
| 013 | 0·571 | 0·286 | — | 0·143 |
| 022 | 0·600 | — | 0·200 | — |
| 023 | 0·632 | — | 0·211 | 0·157 |
| 033 | 0·666 | — | — | 0·167 |
| 111 | — | 0·333 | — | — |
| 112 | — | 0·375 | 0·250 | — |
| 113 | — | 0·400 | — | 0·200 |
| 122 | — | 0·429 | 0·286 | — |
| 123 | — | 0·462 | 0·308 | 0·231 |
| 133 | — | 0·500 | — | 0·250 |
| 222 | — | — | 0·333 | — |
| 223 | — | — | 0·364 | 0·273 |
| 233 | — | — | 0·400 | 0·300 |
| 333 | — | — | — | 0·333 |

| NAME | SCORE | STAKE | DIFF | CHARITY POOL |
|---|---|---|---|---|
| NICK | 1/1 | $10.00 | -$2.50 | $7.50 |
| JOHN | 0/1 | $10.00 | +$5.00 | $15.00 |
| JANE | 1/1 | $10.00 | -$2.50 | $7.50 |

FIG. 2A

| NAME | SCORE | STAKE | DIFF | CHARITY POOL |
|---|---|---|---|---|
| NICK | 2/2 | $10.00 | -$2.50 | $7.50 |
| JOHN | 1/2 | $10.00 | +$1.25 | $11.25 |
| JANE | 1/2 | $10.00 | +$1.25 | $11.25 |

FIG. 2B

| NAME | SCORE | STAKE | DIFF | CHARITY POOL |
|---|---|---|---|---|
| NICK | 3/3 | $10.00 | -$3.08 | $6.92 |
| JOHN | 1/3 | $10.00 | +$3.85 | $13.85 |
| JANE | 2/3 | $10.00 | -$0.77 | $9.23 |

FIG. 2C

| SCORES | 0 | 1 | 2 | 3 |
|---|---|---|---|---|
| 000 | 0·333 | – | – | – |
| 001 | 0·400 | 0·200 | – | – |
| 002 | 0·429 | – | 0·142 | – |
| 003 | 0·444 | – | – | 0·111 |
| 011 | 0·500 | 0·250 | – | – |
| 012 | 0·545 | 0·272 | 0·182 | – |
| 013 | 0·571 | 0·286 | – | 0·143 |
| 022 | 0·600 | – | 0·200 | – |
| 023 | 0·632 | – | 0·211 | 0·157 |
| 033 | 0·666 | – | – | 0·167 |
| 111 | – | 0·333 | – | – |
| 112 | – | 0·375 | 0·250 | – |
| 113 | – | 0·400 | – | 0·200 |
| 122 | – | 0·429 | 0·286 | – |
| 123 | – | 0·462 | 0·308 | 0·231 |
| 133 | – | 0·500 | – | 0·250 |
| 222 | – | – | 0·333 | – |
| 223 | – | – | 0·364 | 0·273 |
| 233 | – | – | 0·400 | 0·300 |
| 333 | – | – | – | 0·333 |

FIG. 7

| SCORES | 0 | 1 | 2 | 3 | 4 |
|---|---|---|---|---|---|
| 0112 | ·429 | ·214 | ·143 | – | – |
| 0123 | ·480 | ·240 | ·160 | ·120 | – |
| 0144 | ·526 | ·263 | – | – | ·105 |
| 0223 | ·522 | – | ·174 | ·130 | – |
| 1223 | – | ·353 | ·235 | ·176 | – |
| 1234 | – | ·390 | ·260 | ·195 | ·156 |
| 2234 | – | – | ·299 | ·224 | ·179 |
| 2344 | – | – | ·339 | ·254 | ·203 |
| 3334 | – | – | – | ·263 | ·211 |
| 3444 | – | – | – | ·294 | ·235 |

FIG. 8

GAME AND ASSOCIATED APPARATUS

BACKGROUND OF THE INVENTION

The present invention relates to a game and its associated apparatus.

SUMMARY OF THE INVENTION

In particular, the game has as its intention a competitive means for allocating contributions to charity. The intention is that before the game is begun the players will agree on a certain financial contribution that they collectively will make to a certain charity, and once the game is completed individual scores are used to determine the respective amounts that each player must contribute to produce an overall charity contribution corresponding to the original stake. By "charity" in this Application is meant any contribution to any cause, preferably external of the players. It is not intended to be limited to "good causes" as such. For example, players might use the game to decide who pays a restaurant bill. The eventual recipient of funds raised by the game is not essential to the invention.

Thus, the present invention provides a method of apportioning a stake comprising:

- a method of generating scores for each player based on a combination of their luck, skill and knowledge;
- a storage means for recording the scores of each player; and
- a distribution means for allocating an initial stake in dependence on the content of the storage means, wherein the distribution means is arranged to allocate a greater proportion of the stake to the player with the lowest score than to the player with the highest score. Thus, the loser makes the greatest contribution to charity.

In known games, a stake is collected prior to playing, but is distributed amongst the players, with the highest score commanding a larger proportion of the stake.

The exact relation between the scores and the required contribution is not essential to the invention, but forms a particularly preferred version thereof. However, it will ideally be fair and equitable, and with this in mind a preferred relation is one in which the distribution means calculates A(P) as 1/(S+N) where N is the score for player P stored in the storage means, and allocates to player P a fraction of the stake being A(P) divided by the total of such A values for all players. S is a "sensitivity" factor. It is a preset, fixed, amount to compensate for the fact that some games award one point per success, whilst some award 10,000. In preferred versions of the invention, the sensitivity can be fixed by the players in advance, or a default setting used. This is however not essential and less preferred embodiments (e.g. those programmed to run on limited-resource platforms) may only have a default value.

Preferably, the calculation process is carried out continuously to give a constant update.

The distribution means can comprise a look-up table from which can be extracted the appropriate stake fraction for the instantaneous content of the storage means. Alternatively, the distribution means can comprise an electronic calculation unit to perform the relevant calculation on each occasion.

A preferred method of generating scores is a question and answer game. In this case, it is a preferred feature of the invention for the answer presentation means to be adapted to provide hints to a particular player by displaying successive incremental portions of the answer in a stepwise fashion.

The successive incremental portions can comprise a single letter of a written answer. Research shows that the recall rate of a fact is increased by 50% if the subject is shown the initial letter of the answer, so the hint may be particularly effective one. Clearly, if the player requires several incremental portions to be displayed before correctly answering, then a form of arbitration procedure will be needed to determine whether the eventual answer counts as correct or not. This can simply be the collective decision of the remaining players.

Other suitable ways of generating scores are card games, computer games and the like.

The game can be implemented on paper, by providing a box of cards each bearing a question and answer. An individual card can be held in a rack, being the answer presentation means, which preferably has suitable blanking plates thereby to display the question whilst concealing the answer. The card can then be moved relative to the rack thereby to display successive incremental portions of the answer. A score card will be provided to record scores, and a look-up table can be provided to calculate charity contributions from the scores.

The preferred implementation of the game, however, is as a suitably programmed computer. By "computer" is meant an electronic device incorporating a microprocessor. This can be implemented either as a stand-alone PC containing a data base with the questions and answers and a display means for displaying the questions, answers and/or parts of answers, and the scores. Alternatively it can be via a central processor accessing a memory store holding the questions and answers, linked via a communication line to a remote terminal including an answer presentation means and storage means for scores. The distribution means can either be provided at the central processor or at the remote terminal/calculation unit. In this implementation, the distribution means is more likely to be implemented as a suitable arithmetic calculation means which can calculate an instantaneous distribution of the stake. This will generally be integrated into the remainder of the program.

The terminal can thus be a suitably programmed computer. The communication line may be a telephone link, for example a terrestrial telephone line or radio telephone link.

In a further alternative, the game can be implemented on a lap-top, hand-held PC ("palm top") or the like or sufficiently capable calculator, or a dedicated electronic unit, preferably hand held. Such devices are well known and the skilled programmer will be able to carry out this implementation.

The questions and answers can be recorded in digital form, for example on a CD-ROM. In this case, it may be opportune to store the question and answers on the spare capacity of a standard music CD. This is possible since a standard album is approximately 55 minutes, whilst a CD can store 79 minutes of sound, leaving an excess of about 200 megabytes. In this case, the questions and answers can be related to the music on the remainder of the CD. Thus, there will then be supplied a CD containing data representing sound and distinct digital data representing a question and answer source. Alternatively, the data could be transmitted via the spare capacity of a TV signal.

The present invention also relates, in its second independent aspect, to the game itself. Thus, there is provided a game in which the players each contribute a sum to a charity pool, and are in turn asked questions of a general-knowledge nature, wherein after a predetermined number of questions players must contribute further to, or receive a refund from, the pool an amount calculated from the individual scores of the players, those players who have obtained the best score obtaining a refund and vice versa.

Of course, simple credit arrangements can mean that actual payments can be deferred until completion of the game.

In its third independent aspect, the present invention relates to the look-up table suitable for use in conjunction with the game apparatus and rules of the first and second aspects.

It therefore provides an apparatus for determining an apportionment ratio from an individual game score set and the basis of a preset relation, wherein the relation is commutative and the apparatus has means for holding a first list being a selection from the totality of possible scores for that game, the selection comprising one member from each of the subsets of the totality of possible scores which subsets consist of the individual score sets which differ only in the order of individual scores;

the apparatus having means for holding further, associated, lists, the further lists containing ratios for a particular individual score.

This can be implemented as a reference card in which the lists are tabulated, associated entries being aligned.

Preferably there are 3 or 4 scores per set, i.e. a 3 or 4 player game. This is simply because 3 or 4 questions each for 3 or 4 players gives a game of reasonable length given the average human attention span.

If more questions are required than catered for in a particular card, then the stake can be divided into portions and the game played for each stake portion. Thus a $30 total stake could be used for, effectively three games played for $10 each.

It can also be implemented as an organised computer memory store. In that case, the computer might retrieve an apportionment ratio by noting the score set, sorting the elements of the score set to remove order information therefrom, scan the first list for an identical entry, and retrieve ratios from associated entries in the further lists.

It is also possible to employ the present invention where the result of the game is a ranking (i.e. 1st place, 2nd place . . . etc). Then the rankings are treated as scores and either the one's complement of the apportionment ratios produced are used to calculate a contribution, or the ratios are treated as refunds for each player from the pool (less their original contribution).

Thus, where a $10 stake is being distributed around three players who have paid $3.33 up front, the ratios will be 0.462, 0.231 and 0.308 (taking the example of FIG. 8 and assuming no draws), giving a refund for the winner of $4.62 less $3.33, ie $1.29, etc.

Embodiments of the present invention will now be described, by way of example, with reference to the accompanying FIGS., in which:

BRIEF DESCRIPTION OF THE DRAWINGS

FIG. 2 is a representation of the scores and calculated stakes at various stages of a fictional game;

FIG. 7 shows a look-up table suitable for a three-player game, and

FIG. 8 shows part of a look-up table suitable for a four-player game.

DETAILED DESCRIPTION

Figure 1:
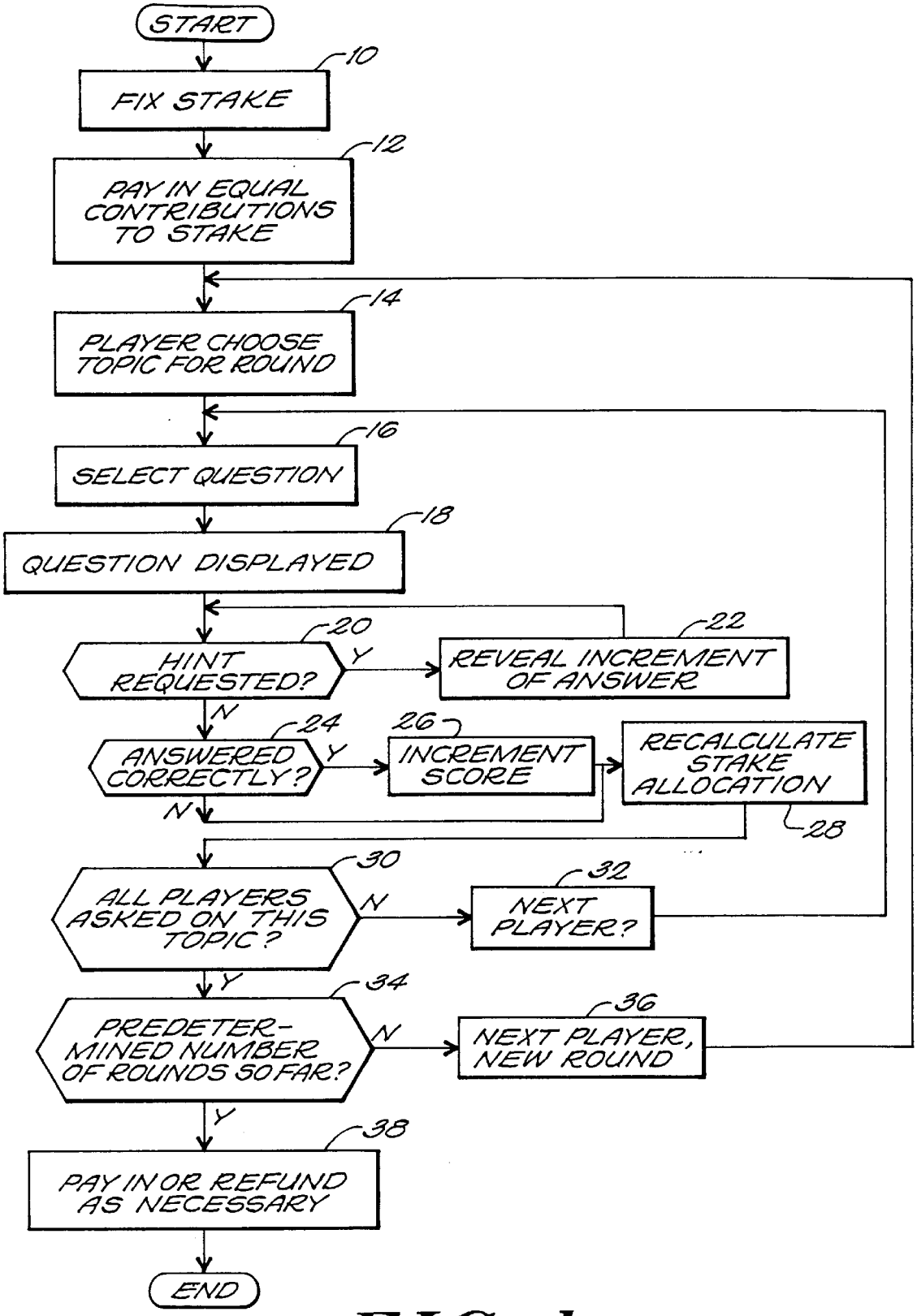
FIG. 1 is a flow chart showing the rules of the game.

FIG. 1 shows the rules of the game as applied to a question and answer based scoring system, and will be described in conjunction with FIG. 2 showing the results during the course of the game. This fictional game has three players, Nick, John and Jane, and is based on questions and answers. One point is awarded per correct answer, and S has been set at one, in this case. The first step is to fix the stake which will eventually be paid to charity. In this example, Nick, John and Jane agree (step 10) to a combined stake of $30 i.e. $10 each. They then pay in $10 each to the central pool, step 12.

To begin the game, one topic of a range of possible topics is chosen, step 14. One question from a group of such questions on that topic is chosen, either on a sequential or a random basis, step 16. That question is displayed for all players to see, step 18.

The players answer questions in sequential order, so the first question must be answered by Nick. If Nick is unable to answer, he may request a hint, step 20. If he does so, a small portion of the answer is revealed through the apparatus of the present invention, step 22. Nick may ask for further hints if he wishes, step 20, in which case further increments of the answer are revealed, step 22. Eventually, Nick must provide an answer for the question, and it is up to John and Jane to decide whether Nick's answer is counted as correct, bearing in mind the number of hints that Nick needed. This decision is for John and Jane, (step 24), although Nick may wish to be heard. If John and Jane's decision is that the answer was correct, one point is recorded for Nick. In the present example, Nick correctly answers his question, FIG. 2*a*. The stake allocation should then be recalculated, step 28, to show the players how they are faring. Clearly, at this stage with one point for Nick and no points yet scored by Jane or John the allocation will be very much in Nick's favour. Thus, there is additional pressure on John and Jane to answer their questions correctly. However, it is not necessary to calculate the stake after each question.

Since not all the players have yet answered a question (steps, 30 & 32), a further question is then selected from the same topic for the next player, (John). Steps 16 to 32 are then repeated for John, and then subsequently Jane. In the fictional example shown in FIG. 2, the pressure of seeing the pool tilted so far in Nick's favour is too much for John and he is unable to answer the question. Jane however keeps a cool head and is able to answer correctly. Then, the allocation of the stake calculated from the scores will be as shown in FIG. 2*a*, under the heading "Charity Pool". This also shows how were the game to end now, Nick and Jane would each receive $2.50 from the pool, while John would have to contribute $5.00.

Once all players have been questioned on a particular topic, the game can move on to the next round of questions, steps 34 and 36. For the new round, the players can choose a new topic, or remain with the same topic. Steps 16 to 32 are once again repeated for each player. In our hypothetical game, Nick again answers correctly. John answers correctly this time, but Jane is unable. The charity pool allocation is therefore still in Nick's favour, who is due his refund of $2.50, but John and Jane now on a level pegging must make a contribution of $1.25 to pay for Nick's refund.

After the agreed number of rounds has been played in our example 3, the players pay in or receive refunds from the pool as necessary, step 38. In our example, Nick retained his winning streak and receives a refund of $3.08. John lost his lucky streak and must now make a contribution of $3.85. Jane recovered at the last moment and is entitled to a refund of $0.77. The state of the scores and charity pool is shown at FIG. 2*c*.

The game of the present invention can be put into effect on a suitably programmed computer, and bearing in mind the necessary calculations this is the preferred option.

In this case, the simplest way to provide the present invention is as a single computer programme comprising an encyclopedia-like source of questions and answers and a user interface, preferably graphical. Questions and answers can be presented via the user interface, and hints can be given by displaying the answer letter by letter. The type of computer is not particularly important; it can be a standard PC, a lap top or palm top, or even a sufficiently capable calculator. When programmed on a calculator or palm top or the like, the game will be totally portable.

In a further version, the question and answer source can be at a remote data bank, communicating with a terminal via a communications link. The communications link can be a standard telephone line, or other data link. This will enable the question and answer source to be significantly larger. It also provides a revenue opportunity for game providers who can charge for use of the communication link.

It is even possible for the game to be played by telephone; in this case a remote computer and speech synthesizer can receive instructions from a representative player, by speech or by tone signal produced by the dialling pad, and dictate questions over the telephone line. For example, the speech synthesizer might say "to indicate a correct answer, dial 1, to indicate a incorrect answer, dial 2, to request a hint, dial 3". This could be played via a portable telephone which should mean that the game could be played anywhere and would require no equipment on the part of the users whatsoever.

The game can be implemented on paper, and FIGS. 3 to 7 show suitable apparatus for doing so.

Figure 3:
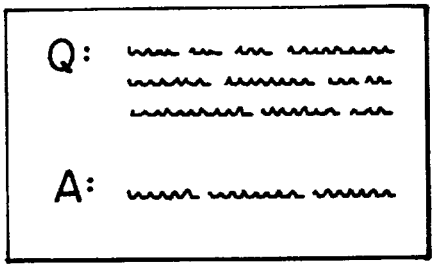
FIG. 3 is a representation of a question and answer card according to a paper embodiment of the invention.
Figure 4:
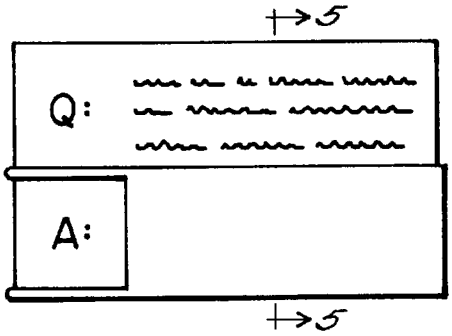
FIGS. 4 and 5 show the card of FIG. 3 and a rack in front and side view respectively.
Figure 5:
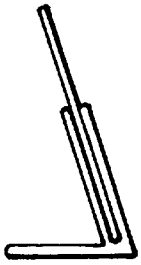
Figure 6:
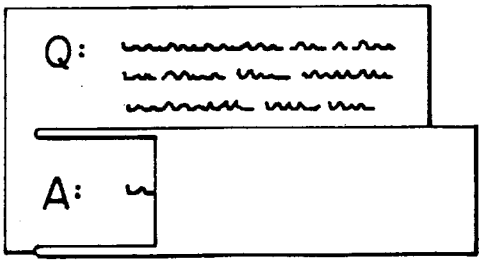
FIG. 6 shows the card and rack of FIG. 4, in front view, after a hint has been requested and given.

FIG. 3 is a question card being of a conventional size with a question printed on the upper half and an answer printed on the lower half. FIGS. 4 and 5 show the question card of FIG. 3 inserted in a suitable stand. This stand has a flat base portion from which project at an acute angle a pair of parallel card receiving plates. The card is placed between the plates and retained in a nearly upright position suitable for reading. The plates are roughly half as long as the card is high, and therefore they cover the lower, answer, portion of the card leaving visible the upper question part. An aperture at the left side of the plates reveals the letter A indicating the answer. To provide a hint, the question card can be shifted a small step to the left to reveal the initial part of the answer through the aperture. Further shifts of the card to the left reveal further portions of the answer. It is likely that the card will eventually fall out of the stand, in which case the other players may decide that the player being questioned has failed to answer the question correctly.

After each question, the scores are calculated and recorded on a score card which may be substantially as shown in FIG. 2. The players can then calculate the charity pool using a known and conventional hand held calculator or other arithmetic means. Alternatively FIGS. 7 and 8 show simple look-up tables catering for three or four players and up to three or four questions each, respectively. To use the tables, the players look up their score pattern in the first list, presented in the left-hand column ("scores") and use the further lists in the numbered columns to look up the multiplication factor applicable to them. For example, if the scores are 3-0-2, the row headed "023" of FIG. 7 is selected, which shows that the player scoring 0 must pay 0.632 of the total stake, the player scoring 20.211 of the total, and the player scoring 30.157 of the total.

In FIG. 7, the scores 000, 111 and 222 have been included, but these are not essential since it is clear in this instance that the pool is divided equally.

The above versions are preferable embodiments of the invention, and it will appreciated by the skilled person that many variations may be made without departing from the scope of the present invention.

What is claimed is:

1. An apparatus for determining an appointment ratio comprising:

game score storage means for storing a game score set;

first list holding means for holding a first list being a selection from the totality of possible scores for that game;

means for generating the first list, said means being adapted to sort all possible scores by order of scores, delete scores which are identical after sorting, and store the resultant list in the first list holding means;

means for holding at least one further list, the further list containing ratios associated with a particular individual score;

first comparison means for comparing the content of the game score storing means with entries in the first list holding means and selecting a closest second match comparison means for comparing the output of the first comparison means with entries in the further list and selecting a ratio associated with a closest match; and means for displaying the selected ratio.

* * * * *